US009802113B2

(12) United States Patent
Shigeta

(10) Patent No.: US 9,802,113 B2
(45) Date of Patent: Oct. 31, 2017

(54) PORTABLE SHUFFLING DEVICE

(71) Applicant: Angel Playing Cards Co., Ltd., Osaka (JP)

(72) Inventor: Yasushi Shigeta, Kyoto (JP)

(73) Assignee: ANGEL PLAYING CARDS CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 14/369,075

(22) PCT Filed: Dec. 19, 2012

(86) PCT No.: PCT/JP2012/008119
§ 371 (c)(1),
(2) Date: Jun. 26, 2014

(87) PCT Pub. No.: WO2013/099159
PCT Pub. Date: Jul. 4, 2013

(65) Prior Publication Data

US 2014/0353913 A1 Dec. 4, 2014

(30) Foreign Application Priority Data

Dec. 26, 2011 (JP) ..... 2011-290696

(51) Int. Cl.
*A63B 67/00* (2006.01)
*A63F 1/12* (2006.01)

(52) U.S. Cl.
CPC ..... *A63F 1/12* (2013.01)

(58) Field of Classification Search
CPC ..... A63B 67/00; A63B 71/00; A63F 9/00
(Continued)

(56) References Cited

U.S. PATENT DOCUMENTS 2,676,020 A * 4/1954 Ogden ..... 273/149 R
3,589,730 A * 6/1971 Slay ..... 273/149 R
(Continued)

FOREIGN PATENT DOCUMENTS

CN 1498126 A 5/2004
CN 2848304 Y 12/2006
(Continued)

OTHER PUBLICATIONS

Chinese Patent Application No. 201280064419.2, Office Action and Search Report dated Dec. 3, 2015.
(Continued)

*Primary Examiner* — Aarti B Berdichevsky
*Assistant Examiner* — Dolores Collins
(74) *Attorney, Agent, or Firm* — Norton Rose Fulbright US LLP

(57) ABSTRACT

A shuffling device (1) includes cards (2) containing information for determination of proper/improper, card set trays (3) for placing the cards (2), and a common card stocker (4) for stocking cards drawn out from the card set trays (3). Drawing rollers (5,6) are provided below the card set trays (3) to draw out the cards (2) from the card set trays (3) to the card stocker (4). A control device (8) includes number-of-cards determining means for determining a number of cards to be drawn out by randomly changing, each time, the number of cards to be drawn out at one time within a range of a predetermined value, and controlling the drawing means, where the cards (2) are drawn out from only one of the card set trays (3) such that the cards (2) are not simultaneously drawn out from more than one of the card set trays (3).

35 Claims, 4 Drawing Sheets

(58) Field of Classification Search
USPC ..... 273/447
See application file for complete search history.

(56) References Cited

U.S. PATENT DOCUMENTS

| | | | | |
|---|---|---|---|---|
| 4,310,160 | A * | 1/1982 | Willette | A63F 1/12 271/219 |
| 5,224,712 | A * | 7/1993 | Laughlin et al. | 273/304 |
| 5,695,189 | A * | 12/1997 | Breeding et al. | 273/149 R |
| 6,267,248 | B1 * | 7/2001 | Johnson et al. | 209/547 |
| 6,629,894 | B1 * | 10/2003 | Purton | 463/47 |
| 6,651,982 | B2 * | 11/2003 | Grauzer et al. | 273/149 R |
| 6,726,205 | B1 * | 4/2004 | Purton | A63F 1/14 273/148 R |
| 6,889,979 | B2 * | 5/2005 | Blaha et al. | 273/149 R |
| 7,036,818 | B2 * | 5/2006 | Grauzer et al. | 273/149 R |
| 7,523,935 | B2 * | 4/2009 | Grauzer et al. | 273/149 R |
| 7,584,962 | B2 * | 9/2009 | Breeding et al. | 14/369.075 |
| 7,594,660 | B2 * | 9/2009 | Baker et al. | 273/149 R |
| 7,753,374 | B2 * | 7/2010 | Ho | 273/149 R |
| 8,150,157 | B2 * | 4/2012 | Downs et al. | 382/181 |
| 8,612,029 | B2 * | 12/2013 | Cottrell et al. | 700/78 |
| 2003/0075866 | A1 | 4/2003 | Blaha et al. | |
| 2004/0026636 | A1 * | 2/2004 | Shigeta | 250/556 |
| 2007/0194524 | A1 * | 8/2007 | Toyama et al. | 273/149 R |
| 2008/0143048 | A1 | 6/2008 | Shigeta | |
| 2010/0327525 | A1 | 12/2010 | Shigeta | |

FOREIGN PATENT DOCUMENTS

| | | | |
|---|---|---|---|
| CN | 101310803 | A | 11/2008 |
| JP | 57183880 | | 11/1982 |
| JP | 10507103 | | 7/1998 |
| JP | 2007236995 | | 9/2007 |
| JP | 2008012360 | | 1/2008 |
| JP | 2009527330 | | 7/2009 |
| WO | 9604970 | | 2/1996 |
| WO | 02064225 | | 8/2002 |
| WO | 2005089893 | | 9/2005 |
| WO | 2009069708 | | 6/2009 |

OTHER PUBLICATIONS

International Application No. PCT/JP2012/008119, International Search Report dated Apr. 2, 2013.

* cited by examiner

PORTABLE SHUFFLING DEVICE

CROSS-REFERENCE TO RELATED APPLICATIONS

This application is a national stage application pursuant to 35 U.S.C. §371 of International Application No. PCT/JP2012/008119, filed Dec. 19, 2012, which claims priority to Japanese Patent Application No. 2011-290696, filed Dec. 26, 2011, the disclosures of which are hereby incorporated by reference herein.

TECHNICAL FIELD

The present invention relates to a shuffling device for one or a plurality of decks of playing cards to be used in various card games such as poker, baccarat, bridge or blackjack. Moreover, the present invention may also be used for cards other than playing cards, such as trading cards, and relates to a shuffling device for cards for various games where a set of predetermined cards has to be shuffled before the game or where proper/improper of the cards has to be determined.

BACKGROUND ART

In various card games such as poker, baccarat, bridge and blackjack, a dealer sets one or a plurality of decks of playing cards in a card shooter or the like, draws out cards one at a time, and deals the cards to the game players. At this time, to guarantee fairness of the game, the cards have to be randomly dealt out, and the game host has to sufficiently randomly shuffle the playing cards before setting the cards in the card shooter.

Incidentally, a device for manufacturing shuffled cards is disclosed in Patent Literature 1, for example.

Also in the case of using shuffled cards that are already shuffled in advance, there is room for a dishonest act such as removal/insertion or replacement of cards before the cards are used on the game table.

CITATION LIST

Patent Literature

Patent Literature 1: International Publication No. WO 2009/069708

SUMMARY OF INVENTION

Technical Problem

The present invention is made in view of the background described above. The object of the present invention is to provide shuffled playing cards that leave no room for dishonest acts, by reshuffling the shuffled playing cards to be used in a game before the game.

To achieve the object described above, a portable shuffling device of the present invention includes two card set trays for placing stacks of a plurality of cards that are shuffling targets, a common card stocker for collectively stocking cards drawn out from the two card set trays at one position, first drawing means and second drawing means, provided respectively below the two card set trays, for drawing out the cards into the card stocker from the card set trays one by one, a motor for driving the first drawing means and the second drawing means, and control means for performing control of selectively operating the first drawing means and the second drawing means and selectively drawing out a card that is on either of the two card set trays, wherein the device stocks cards placed on the two card set trays collectively in the common card stocker and shuffles the plurality of cards, and wherein the control means includes number-of-cards determining means for determining the number of cards to be drawn out by randomly changing, each time, the number of cards to be drawn out at one time within a range of a predetermined value, and controlling the drawing means, where a card is drawn out only from one of the card set trays such that cards are not simultaneously drawn out from the card set trays.

Also, the portable shuffling device of the present invention may further include a proper/improper determination device including a memory storing information about a proper card for determining proper/improper of the plurality of cards that are shuffling targets, the proper/improper determination device being for sequentially acquiring information from the plurality of cards that are shuffling targets, comparing the acquired information with the information about a proper card, and determining proper/improper of the card.

Furthermore, a card shuffling system of the present invention includes cards each having information for determining proper/improper of the card added to a card surface by invisible ink or material, and a device for having the cards divided and placed on two card set trays, and for stocking the cards in a common card stocker and shuffling a plurality of cards, wherein the device for shuffling the plurality of cards includes the two card set trays for placing stacks of a plurality of cards that are shuffling targets, the common card stocker for collectively stocking cards drawn out from the two card set trays at one position, first drawing means and second drawing means, provided respectively below the two card set trays, for drawing out cards into the card stocker from the card set trays one by one, a motor for driving the first drawing means and the second drawing means, and control means for performing control of selectively operating the first drawing means and the second drawing means and selectively drawing out a card that is on either of the two card set trays, wherein the control means includes number-of-cards determining means for determining the number of cards to be drawn out by randomly changing, each time, the number of cards to be drawn out at one time within a range of a predetermined value, and controlling the drawing means, where a card is drawn out only from one of the card set trays such that cards are not simultaneously drawn out from the card set trays.

According to the present invention, a predetermined number of cards to be used in a card game may be shuffled on the game table or the like to thereby prevent occurrence of cheating.

As will be described below, the present invention includes other modes. Therefore, the disclosure of the invention intends to provide some modes of the present invention, and does not intend to limit the scope of the invention described and claimed herein.

DESCRIPTION OF EMBODIMENTS

Figure 1:
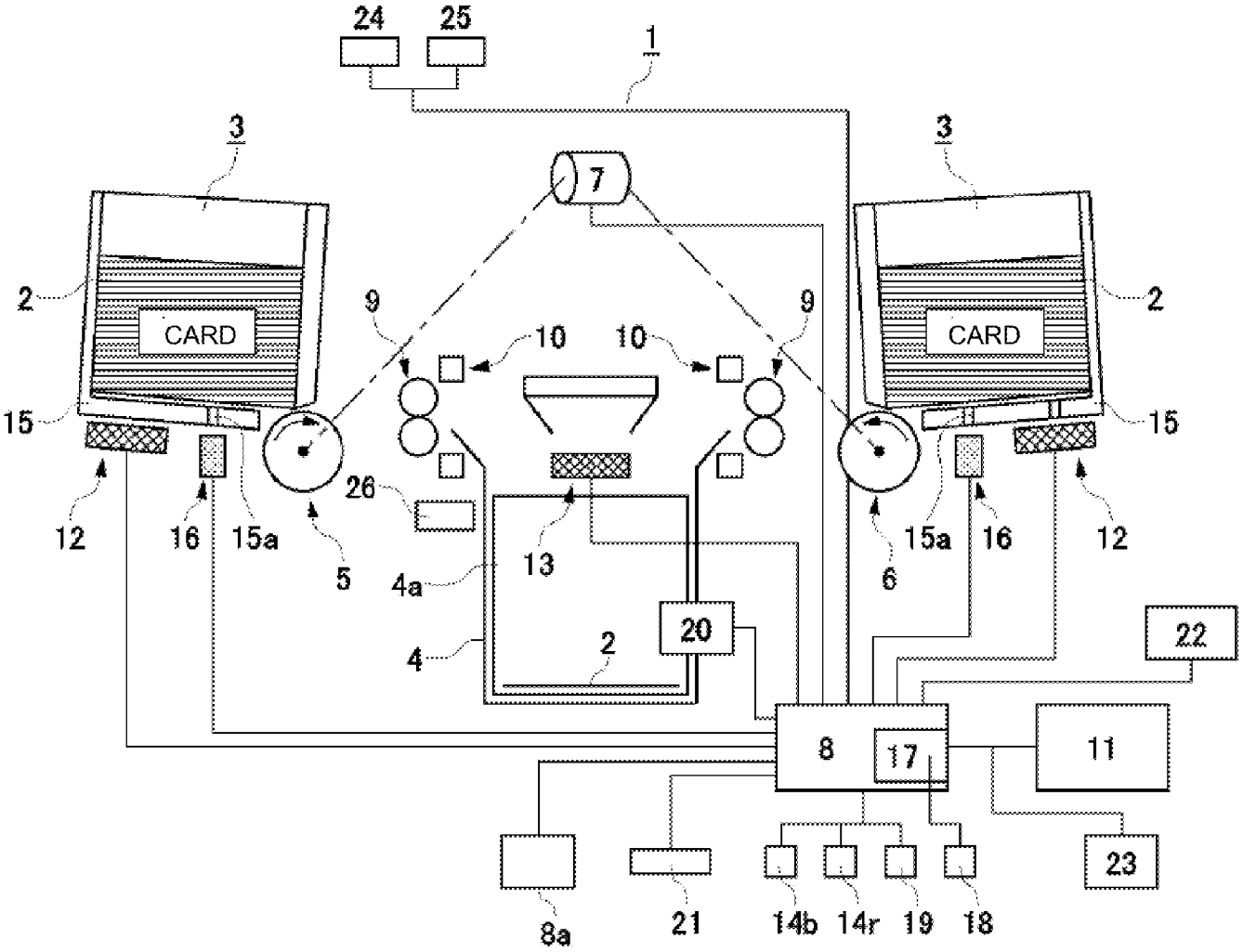
FIG. 1 is a schematic side view of a portable shuffling device of a card shuffling system according to Embodiment 1 of the present invention.

Hereinafter, a detailed description of the present invention will be given. However, the following detailed description and accompanying drawings are not to limit the invention.

Embodiment 1 of the present invention will be described with reference to a drawing. A portable shuffling device 1 of a card shuffling system according to Embodiment 1 of the present invention includes two card set trays 3 for placing stacks of a plurality of cards 2 (shuffled cards which are already shuffled) that are shuffling targets, and a common card stocker 4 for collectively stocking cards drawn out from the two card set trays 3 at one position. A drawing roller 5, which is first drawing means, and a drawing roller 6, which is second drawing means, are provided respectively below the two card set trays 3 to draw out the cards 2 from the card set trays 3 to the card stocker 4 one by one. The first drawing roller 5 and the second drawing roller 6 are rotated by a driving motor 7. This driving motor 7 uses a stepper motor. The first drawing roller 5 and the second drawing roller 6 are selectively rotated by the driving motor 7 being controlled. Control of the driving motor 7 is performed by a control device 8. The control device 8 includes number-of-cards determining means for determining the number of cards to be drawn out by randomly changing, each time, the number of cards to be drawn out at one time within a range of a predetermined value, and controlling the drawing means, where the cards 2 are drawn out only from one of the card set trays 3 such that cards are not simultaneously drawn out from the two card set trays 3.

The driving motor 7 uses one common stepper motor, and by switching the rotation direction between left and right, causes one of the first drawing roller 5 and the second drawing roller 6 to operate. Additionally, for this purpose, the first drawing roller 5 and the second drawing roller 6 are provided with a one-way clutch, not shown.

In this manner, with one of the first drawing roller 5 and the second drawing roller 6 being selectively driven, only the cards on one of the two card set trays 3 are selectively drawn out. Cards drawn out from each of the first drawing roller 5 and the second drawing roller 6 are fed to the card stocker 4 by a pair of feed rollers 9 rotating at all times. The driving speed of the feed rollers 9 is set such that cards are fed at a higher speed than the speed of the cards fed by the first drawing roller 5 and the second drawing roller 6, and thus, the cards 2 are reliably sent to the card stocker 4 by being pulled by the feed rollers 9. The cards 2 which have been fed are detected by a card sensor 10, and the number of cards 2 sent to the card stocker 4 is counted by the control device 8 based on a signal of the card sensor 10. This counting is performed, and the count is stored, by a shuffled card counter (not shown) in the control device 8. Also, the total count value of the shuffled card counter regarding the cards 2 sent to the card stocker 4 is displayed on a display 11. In the present embodiment, a card case 4*a* is set in the card stocker 4, and the cards 2 are held inside the card case 4*a* while being stacked over one another. This card case 4*a* is colored to be opaque or black so that the cards 2 cannot be seen from outside, and the cards 2 inside the card case 4*a* cannot be turned over from outside, and also, extraction of the cards 2 is prevented, and the cards 2 may be securely treated.

The control device 8 includes a function for randomly changing, each time, within a range of a predetermined value (for example, five), the number of cards to be drawn out from the two card set trays 3 at one time, and changing the number of cards to be drawn out between one and five, and controls the motor 7 of the drawing rollers 5 and 6, which are the drawing means, by determining a different number of cards to be drawn out each time. For this purpose, the control device 8 includes means for determining the number of cards to be drawn out (not shown). The maximum value of the number of cards to be drawn out that is randomly changed each time is between one and five, and may be set by a liquid crystal panel (8*a*) for setting the number of cards, and the means for determining the number of cards to be drawn out (not shown) randomly changes each time, based on the setting, the number of cards to be drawn out at one time within a range of a predetermined number (for example, five) and changes the number of cards to be drawn out between one and five. Additionally, a key switch (described later) is connected to the control device 8, and it is set such that the maximum value of the number of cards to be drawn out that is randomly changed each time cannot be changed without operating this switch.

Also, the number of cards 2 to be drawn out from the two card set trays 3 by the first drawing roller 5 and the second drawing roller 6 is changed each time, and after a several times, the total number of cards 2 drawn out will be imbalanced between the two drawing rollers 3. Accordingly, the numbers of cards fed from the two card set trays 3 are compared based on outputs of two card sensors 10 for detecting the cards fed via the respective feed rollers 9, and the control device 8 controls each number of cards to be drawn out in such a way that the difference is within a predetermined number of cards. This is performed by the means for determining the number of cards to be drawn out (not shown) of the control device 8.

In this manner, the cards 2 from the two card set trays 3 are not drawn out at the same time, and the number of cards to be drawn out is randomly changed each time, and the cards 2 are alternately sent to the card stocker 4 with the number of cards being different, and thus, the cards 2 from the two card set trays 3 are stocked in the card stocker 4 in a randomly shuffled state.

The two card set trays 3 each include a nonshuffled card detection sensor 12 (detection means) for detecting and outputting absence of the cards 2. Accordingly, when there are no more cards 2 in one of the card set trays 3, a handler may replenish the card set tray 3 by dividing the cards 2 in the other card set tray 3. With respect to the cards 2, normally, a plurality of decks (for example, 416 cards in 8 decks) are used as one set of shuffled cards, and thus, shuffling is performed by dividing and placing the plurality of cards (416 cards) on the two card set trays 3. In this case, the driving motor 7 is operated, the number of cards stocked in the common card stocker 4 is added up, the total number of shuffled cards 4 is aggregated, and the shuffling operation is temporarily stopped when a predetermined number of cards (for example, 208 cards) has been stocked in the common card stocker 4.

This is to prevent inconveniences that occur when a plurality of decks (for example, 416 cards in 8 decks) of cards 2 are stocked in the common card stocker 4 at one time, such as the height (volume) of the cards 2 becoming too great for a handler to easily remove the cards 2 from the card stocker 4 or to hold the cards 2 by one hand. These operations are programmed by the control device 8. The handler removes the cards 2 in the card case 4*a* from the card stocker 4 together with the card case 4*a*, returns the empty card case 4*a* to the card stocker 4, operates a start switch (not shown), and performs a further shuffling operation of operating the driving motor 7 again. This is repeated and cards of the number corresponding to a predetermined number of decks (for example, 416 cards in 8 decks) are shuffled by a plurality of times (two or more times) of shuffling operations. At this time, a stocked card detector 13 for detecting the cards 2 in the card stocker 4 is provided above the card stocker 4, and the control device 8 performs control in such a way that shuffling cannot be restarted when there is a card 2 left behind.

Cards of the number corresponding to a predetermined number of decks (for example, 416 cards in 8 decks) are shuffled by a plurality of times (normally, two times) of shuffling operations. The two card set trays 3 each include the nonshuffled card detection sensor 12 for detecting absence of the cards 2. When there is no more card in one of the card set trays 3, the total count value of the shuffled cards 2 of the shuffled card counter and the number of cards whose shuffling is planned (set) to have been completed (for example, 416 cards) are compared, and the number of remaining cards in the card set tray 3 is calculated. When the number of remaining cards exceeds a predetermined value (for example, eight), the shuffling operation is stopped. When the number of remaining cards is at or below the predetermined number of cards, the shuffling operation is completed without being stopped. After the shuffling operation is stopped, the handler uniformly divides and shares the cards 2 in the card set tray 3 where the remaining cards 2 are with the other card set tray 3 with no cards. Then, by restarting the shuffling operation, the number of cards drawn out from the two card set trays 3 may be made uniform.

When all the cards 2 in both of the card set trays 3 have been drawn out, the portable shuffling device 1 stops the shuffling operation. Then, the total shuffled number according to the shuffled card counter and the number of cards set in advance are compared and match/non-match is detected, and match/non-match is displayed by display means 14 (blue lamp 14*b* and red lamp 14*r*, or the like). At this time, the total shuffled number according to the shuffled card counter is displayed on the display 11 at the same time. By providing a function for setting in advance a predetermined number of cards to be used as authentic shuffled cards (for example, 416 cards in the case where one set of shuffled cards includes 8 decks), if there is an excess or shortfall in the total number of cards already shuffled, display regarding this excess or shortfall is performed on the display 11, and checking of the excess or shortfall and the like by the display means (blue and red lamps, or the like) is enabled (for example, a red lamp 14*r* is lit).

A DNA sensor 16 is provided at a bottom 15 of the card set tray 3, and DNA information is acquired from a DNA-containing ink (described later) applied to the card 2. The DNA sensor 16 radiates UV light on the DNA-containing paint (described later) on the card 2 at the bottom through a through hole 15*a* of the bottom 15, and receives the reflected light of the radiated light. Group information of the card 2 on the card set tray 3 is acquired according to the signal of the DNA sensor 16. The group information is information for determining proper/improper of the card, and the control device 8 includes a proper/improper determination device 17 for determining proper/improper of the card 2 by acquiring the group information from the DNA sensor 16.

The proper/improper determination device 17 for determining the proper/improper of a plurality of cards 2 that are shuffling targets includes a memory (not shown) storing information about a proper card. The information about the proper card used for determination of proper/improper is input in advance from an information input device 18. The group information is sequentially acquired by the DNA sensor 16 from each of the plurality of cards 2 to be shuffled. The acquired group information is compared by the proper/improper determination device 17 with the information about the proper card, and the proper/improper of the card 2 is determined. A proper/improper display lamp 19 is to flash when a card is determined by the proper/improper determination device 17 to be an improper.

Also, when a card 2 is determined by the proper/improper determination device 17 to be an improper, the control device 8 controls each unit such that each unit operates until the card 2 which is determined to be an improper comes at the top of the card case 4*a* of the card stocker 4, but then the operation stops in this state. Moreover, there is provided a card removal lock device 20 for preventing removal of the card case 4*a* of the card stocker 4 and the cards 2 inside when the card 2 is determined by the proper/improper determination device 17 to be an improper. The removal lock device 20 for the card case 4*a* normally uses a lock operation by a known electromagnetic appliance such as a solenoid.

A key switch 21 is connected to the control device 8, and the control device 8 performs control in such a way that the removal lock device 20 for the card case 4*a* is not released and the shuffling operation is not restarted unless the key switch 21 is operated by a key (not shown) of a manager or the like. Additionally, as described above, the maximum value of the number of cards to be drawn out which is to be randomly changed each time may be set by the liquid crystal panel (8*a*) for setting the number of cards, and the control device 8 is set such that this change can also be made only when the key switch 21 (same applies below) is operated by the key (not shown) of the manager or the like. Additionally, in the case the card case 4*a* is not installed, the control device 8 performs control in such a way that a detector 26 of the card case 4*a* is operated and the shuffling operation is not started, and the card removal lock device 20 is not operated.

The removal lock device 20 for the card case 4*a* is operated by the control device 8 also when the number according to the shuffled card counter does not match the number of cards set in advance, and functions to prevent removal of the card case 4*a* and the cards 2 inside. Also in this case, the control device 8 is set such that the removal lock device 20 for the card case 4*a* is not released and the shuffling operation is not restarted unless the key switch 21 is operated by the key.

A time storage device 22 is further connected to the control device 8, and a function for storing the time when the card removal lock device 20 operated and the time when the card removal lock device 20 was released by the key switch 21 is provided. These times may be sent to outside such as a management department by wireless transmission (communication device) 23.

Also, the control device 8 includes, at the top of the main body of the device, a lock state display device 24 for displaying a locked state of the card removal lock device 20, and a lock state display device 25 for displaying an unlocked state, and displays these lock states and the power on state independently of power on display, and enables capturing by a surveillance camera placed above in the casino or the like.

A result of proper/improper determination of the card 2 at the proper/improper determination device 17 of the control device 8 may further be output by an alarm sound or the like, or by a sound other than the alarm sound, such as an audio message or a melody. Also, in the case a card is determined to be an improper by the proper/improper determination device 17, or the number according to the shuffled card counter does not match the number of cards set in advance, this state may also be sent to outside such as the management department by wireless transmission (communication device) 23.

Figure 2:
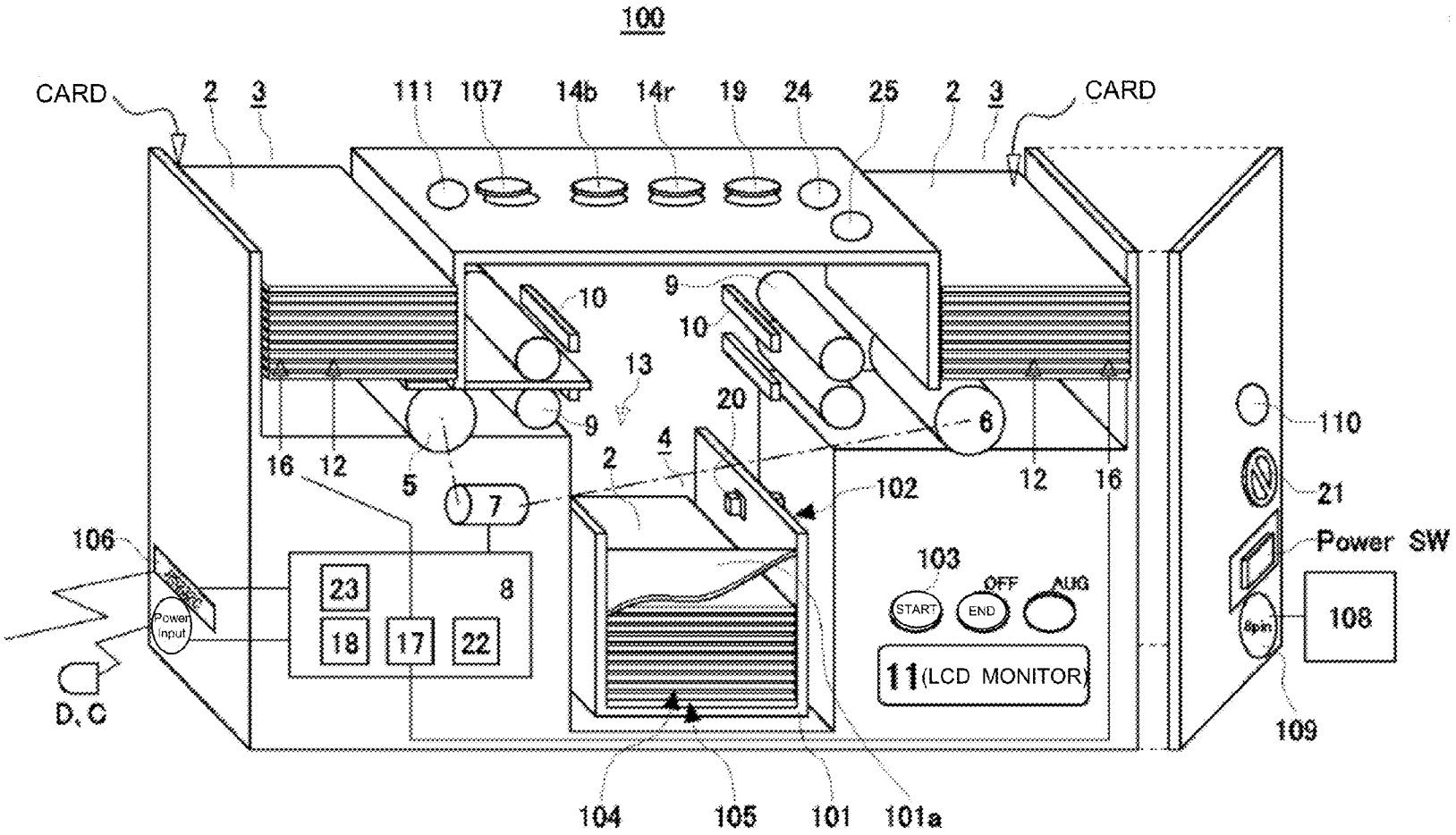
FIG. 2 is a schematic perspective view of a portable shuffling device of a card shuffling system according to Embodiment 2 of the present invention.

Next, Embodiment 2 of the present invention will be described with reference to FIG. 2. Structures of a portable shuffling device 100 of a card shuffling system according to Embodiment 2 of the present invention which are the same as those of the portable shuffling device 1 according to Embodiment 1 will be denoted with the same numbers, and a description thereof will be omitted.

According to the present embodiment, a card receiver 101 is arranged in a card stocker 4 in a manner capable of being removed, and cards 2 are held inside the card receiver 101 being stacked face-down. A cover 101*a* that is colored to be opaque or black so that the cards 2 cannot be seen from outside is provided at the front of the card receiver 101. Accordingly, in a state where this card receiver 101 is set in the portable shuffling device 100, no one can touch the cards 2 inside the card receiver 101, and cheating may be prevented by preventing the cards 2 from being extracted, or turned over and looked at from outside, and the cards 2 may be securely handled.

A control device 8 includes a function for randomly changing, each time, within a range of a predetermined value (for example, five), the number of cards to be drawn out from two card set trays 3 at one time, and changing the number of cards to be drawn out between one and five, and controls a motor 7 of drawing rollers 5 and 6, which are the drawing means, by determining a different number of cards to be drawn out each time. For this purpose, the control device 8 includes means for determining the number of cards to be drawn out (not shown). The maximum value of the number of cards to be drawn out that is randomly changed each time is between one and five, and may be set by a number-of-cards set key (not shown), and the means for determining the number of cards to be drawn out (not shown) randomly changes each time, based on the setting, the number of cards to be drawn out at one time within a range of a predetermined number (for example, five) and changes the number of cards to be drawn out between one and five. The control device 8 checks whether or not drawing out of the number of cards to be drawn out has been reliably performed, based on the outputs of two card sensors 10 for detecting the cards 2 fed by respective feed rollers 9. Also, the control device 8 controls the entire operation in such a way that an abnormality (an error) is detected and the operation of the device is stopped when a card 2 is drawn out from the other feed rollers 9 different from the feed rollers 9 instructed to perform drawing out.

Also, the numbers of cards 2 to be drawn out from the two card set trays 3 by the first drawing roller 5 and the second drawing roller 6 are set to change each time, and after a several times, the total number of cards 2 drawn out will possibly become imbalanced between the two drawing rollers 5 and 6. Accordingly, the control device 8 constantly compares the numbers of cards fed from the two card set trays 3 instructed to perform drawing out, and controls the instructed numbers of cards to be drawn out in such a way that the difference is, at the end, within a predetermined number of cards. Additionally, a key switch (21 described later) described later is connected to the control device 8, and it is set such that the maximum value of the number of cards that is randomly changed each time cannot be changed without operating this switch. (This change is made by an information input device 108 (described later).)

A fullness sensor 102 for detecting that the cards 2 in the card receiver 101 have reached a predetermined number (for example, the cards 2 stop every 140 cards) is provided, and the shuffling operation is thereby temporarily stopped. This is to prevent inconveniences that occur when a plurality of decks (for example, 416 cards in 8 decks) of cards 2 are stocked in the common card receiver 101 at one time, such as the height (volume) of the cards 2 becoming too great for a handler to easily remove the cards 2. These operations are programmed by the control device 8. The handler removes the cards 2 in the card receiver 101 together with the card receiver 101, returns the empty card receiver 101 to the card stocker 4, and operates a start switch (103), and then, the driving motor 7 is operated again and a further shuffling operation is performed. A card receiver sensor 104 for performing detection regarding the card receiver 101 is installed at the bottom of the card stocker 4, and is set such that the shuffling operation is not started and a card removal lock device 20 does not operate in the case the card receiver 101 is not returned to the card stocker 4. Also, a card presence/absence sensor 105 for detecting presence/absence of the cards 2 through a hole (not shown) provided to the bottom of the card receiver 101 is provided, and is programmed to function in such a way that the shuffling operation is not restarted in the case a card 2 remains at the bottom of the card receiver 101 when the empty card receiver 101 is returned to the card stocker 4 after the cards 2 have been removed together with the card receiver 101. By repeating the card shuffling operation in the above manner, cards of the number corresponding to a predetermined number of decks (for example, 416 cards in 8 decks) are shuffled by a plurality of times (three or more times) of shuffling operations.

When all the cards 2 in both of the card set trays 3 have been drawn out, the portable shuffling device 1 stops the shuffling operation. Then, the total shuffled number according to the shuffled card counter and the set number of cards set in advance (for example, 416 cards in 8 decks) are compared and match/non-match of the numbers of cards is detected, and match/non-match is displayed by display means 14 (blue and red lamps, or the like). At this time, the total shuffled number according to the shuffled card counter is displayed on the display 11 at the same time. By providing a function for setting in advance a predetermined number of cards to be used as authentic shuffled cards (for example, 416 cards in the case where one set of shuffled cards includes 8 decks), if there is an excess or shortfall in the total number of cards already shuffled, display regarding this excess or shortfall is performed on the display 11, and checking of the excess or shortfall and the like by the display means (b blue and r red lamps, or the like) is enabled (for example, a red lamp 14*r* is lit when there is an excess or shortfall in the number of cards).

Also in Embodiment 2 of the present invention, a DNA sensor 16 is provided at the bottom of the card set tray 3, and DNA information is acquired from a DNA-containing ink (described later) applied to the card 2. Group information of the card 2 on the card set tray 3 is acquired according to the signal of the DNA sensor 16. The group information is information for determining proper/improper of the card, and the control device 8 includes a proper/improper determination device 17 for determining proper/improper of the card 2 by acquiring the group information from the DNA sensor 16. Additionally, a sensor for reading the suit (type) and the rank (number) of the card 2 is not provided in addition to the proper/improper determination device 17 for determining the proper/improper of the card 2 by acquiring the group information from the DNA sensor 16. This is to prevent a problem of misuse or the like that may occur when the suits (types) and the ranks (numbers) of the cards 2 are read by the portable shuffling machine 100 and information about the arrangement of a plurality of cards 2 which have been shuffled is obtained.

The proper/improper determination device 17 for determining the proper/improper of a plurality of cards 2 that are shuffling targets includes a memory (not shown) storing information about a proper card. The information about the proper card used for determination of proper/improper is input in advance from an information input device 108 via a communication terminal 109. The group information is sequentially acquired by the DNA sensor 16 from the plurality of cards 2 that are shuffling targets. The acquired group information is compared by the proper/improper determination device 17 with the information about the proper card, and the proper/improper of the card 2 is determined. A proper/improper display lamp 19 is to flash when a card is determined by the proper/improper determination device 17 to be an improper.

Also, when a card 2 is determined by the proper/improper determination device 17 to be an improper, each unit operates until the card 2 which is determined to be an improper comes at the top of the card receiver 101 of the card stocker 4, and then the operation stops in this state. By each unit being controlled by the control device 8 in the above manner, a questionable card 2 is placed at the top of the card receiver 101 and examination is facilitated. Furthermore, as in the case of Embodiment 1, there is provided the card removal lock device 20 for preventing removal of the card receiver 101 of the card stocker 4 when a card 2 is determined by the proper/improper determination device 17 to be an improper, and loss of the improper card is prevented.

A key switch 21 is connected to the control device 8, and the control device 8 performs control in such a way that the removal lock device 20 for the card receiver 101 is not released and the shuffling operation is not restarted unless the key switch 21 is operated by a key of a pit manager or the like. In this manner, the card receiver 101 prevents access from the outside into the card stocker 4 including at a time of the shuffling operation, and it is made impossible to put one's hand inside the card receiver 101 of the card stocker 4. In this manner, the card receiver 101 is set to stay in the card stocker 4 at all times except for at the time of an operation of removing the cards in the card receiver 101, access to inside the card stocker 4 is prevented, and installation of a camera or the like in the card stocker 4 for an dishonest intention is prevented. Additionally, the entire device is to be stopped in a state where the card receiver 101 is returned to the card stocker 4. In the case the card receiver 101 is not returned to the card stocker 4, the shuffling operation cannot be started, and the control device 8 is set to perform overall control in such a way that the shuffling operation is not started unless the key switch 21 is operated and the locked state of the device is released, and the card receiver 101 is returned to the card stocker 4.

The removal lock device 20 for the card receiver 101 operates also when the number according to the shuffled card counter does not match the number of cards set in advance, and functions in such a way as to prevent removal of the card receiver 101 and the cards 2 inside. Also in this case, the operation of the control device 8 is set in such a way that the removal lock device 20 for the card receiver 101 is not released and the shuffling operation is not to be restarted unless the key switch 21 is operated by the key.

A time storage device 22 is further connected to the control device 8, and a function for storing, when the card removal lock device 20 is operated or when the key switch 21 is operated by the key such as when the card removal lock device 20 is released by the key switch 21, the type of an abnormality and the time is provided. These times may be sent to outside the portable shuffling device 100, such as a management department, by wireless transmission (communication device) 23 or a wired communication terminal 106.

Also, the control device 8 includes, at the top of the main body of the device, a lock state display device 24 for displaying a locked state of the card removal lock device 20, and a lock state display device 25 for displaying an unlocked state, and displays these lock states independently from a power on display lamp (107), and enables capturing by a surveillance camera placed above in the casino or the like. In this manner, removal of the card receiver 101 is locked by the card removal lock device 20 while the shuffling operation is being performed, and an operation of preventing cheating by preventing an unauthorized access to the cards 2 may be guaranteed, and this is monitored by a ceiling-mounted camera or the like at the casino.

(Description of Pause Function)

During operation of the portable shuffling machine 100, removal of the card receiver 101 is locked by the card removal lock device 20, an unauthorized access to the cards 2 is prevented, and also, the card receiver 101 inside the card stocker 4 is present inside the card stocker 4 at all times (except at the time of operation of removing the cards), and thus, a state where a cheater cannot perform a dishonest act inside the portable shuffling machine 100 may be secured. However, the portable shuffling machine 100 is not used constantly in a table game, and is used to shuffle the cards when the shuffled cards to be used in the game (for example, 416 cards in maximum 8 decks) have been used, or when the shuffled cards are to be replaced by new cards during the game. Thus, the shuffling operation of the portable shuffling machine 100 is performed about once every one hour, for example. There is a risk of unauthorized access to the portable shuffling machine 100 during that time, and thus, the portable shuffling machine 100 includes a pause function.

(Description of Paused State)

The pause function is realized by operating a pause function switch 110, or by the control device 8 automatically placing the portable shuffling machine 100 in the pause state after a predetermined time (for example, about 10 seconds) have passed after a shuffling operation. In the paused state, the portable shuffling machine 100 maintains the locked state of the card removal lock device 20, whereby removal of the card receiver 101 is prevented, and a state where an unauthorized access to the cards 2 is prevented is maintained. Also, the card receiver 101 inside the card stocker 4 is present inside the card stocker 4 at all times (except at the time of operation of removing the cards), and thus, a state where a cheater cannot perform a dishonest act inside the portable shuffling machine 100 may be secured. It is set that this paused state may be released only when the key switch 21 is operated by the key, or when a release operation is performed by an encryption key or the like (not shown). Also, this paused state is displayed at the top of the main body of the device by a paused state display lamp 111 (by changing the color of the power on display lamp 107, the paused state display lamp 111 may be omitted). These states are monitored by a ceiling-mounted camera or the like at the casino, and the pause function operation time is stored in the time storage device 22, and the states are sent to the outside such as the management department by wireless transmission (communication device) 23. Additionally, in Embodiment 2, the card removal lock device 20 is structured to prevent removal of the card receiver 101 by being protruding from a side surface inside the card stocker 4, but in an example modification, the card removal lock device 20 may be provided on the lower part in front of the card receiver 101, and a removal prevention plate (not shown) may be made to move up and down in front of the card receiver 101 by a solenoid or the like.

A result of proper/improper determination of the card 2 at the proper/improper determination device 17 of the control device 8 is notified to the outside by flashing of the proper/improper display lamp 19, but it may also be output to the outside by an alarm sound or the like, or sound other than the alarm sound, such as an audio message or a melody may be output instead. Also, in the case a card 2 is determined to be an improper by the proper/improper determination device 17, or the number according to the shuffled card counter does not match the number of cards set in advance, this state may also be sent to outside such as the management department by wireless transmission (communication device) 23.

Figure 3B:
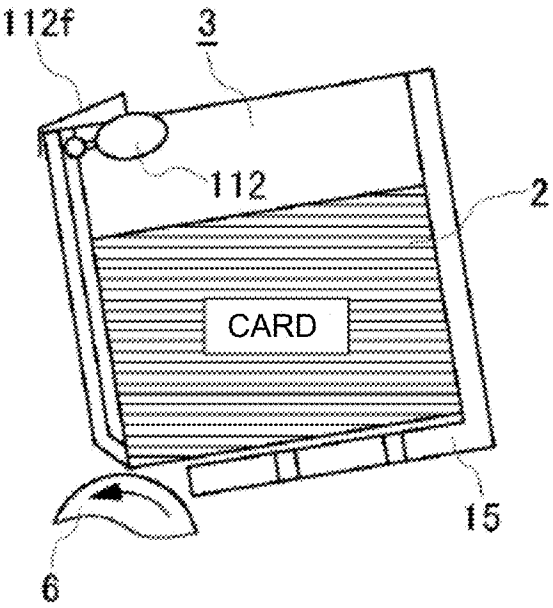
FIGS. 3(*a*) and 3(*b*) are front views of main portions of a card set tray of a portable shuffling device according to an example modification of Embodiments 1 and 2 of the present invention.
Figure 3A:
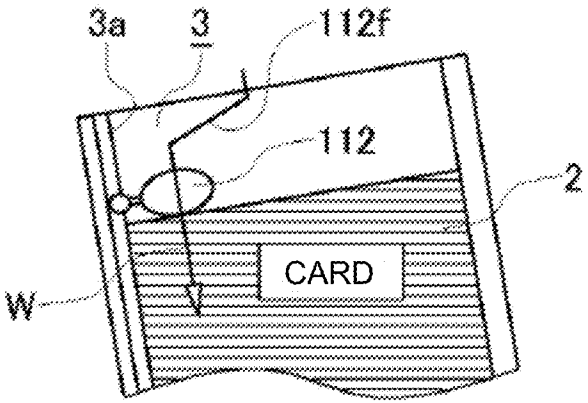

Next, an example modification of Embodiments 1 and 2 will be described with reference to FIGS. 3(*a*) and 3(*b*). In the present example modification, a weight 112 for preventing rising of the cards 2 after the cards 2 have been set in the card set tray 3 is provided. This weight 112 is guided by a guide 3*a* provided to the card set tray 3, presses the cards 2 in the direction of an arrow W by its weight, and helps the cards 2 to reliably come into contact with the drawing roller 5 or 6 and be drawn out. Also, at the time of setting the cards 2 in the card set tray 3, the weight 112 may be temporarily fixed at the top (the state shown in FIG. 3(*b*)) by rotating a fixing hook 112*f*.

Figure 4:
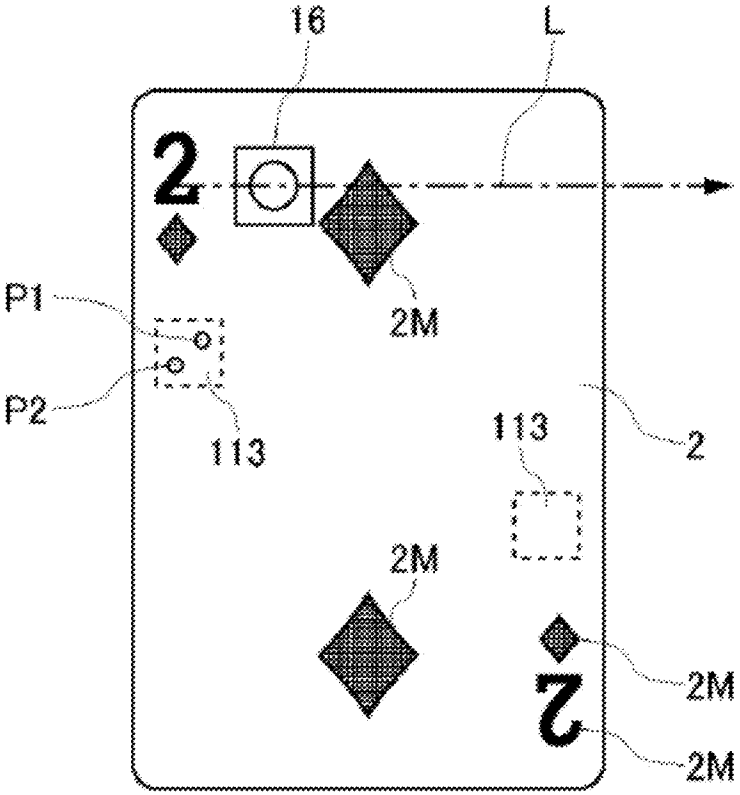
FIG. 4 is a plan view of a card for the card shuffling systems according to Embodiments 1 and 2 of the present invention.

Cards 2 to be used in a card shuffling system of the example modification of Embodiments 1 and 2 of the present invention will be described with reference to FIG. 4. Group information, which is information used for determination of proper/improper of a card, is included in ink (DNA-containing paint) used for printing an index 2M (suit and rank) of every card including face cards (J, Q, K). This ink (DNA-containing paint) is coded by DNA. In Embodiment 1, the "suit" refers to the type of the playing card (heart, spade, etc.) and the "rank" refers to the "number" (for example, ace, 2, 3, . . . , 10, Jack, Queen, King, etc.), and the "suit" and the "rank" are shown on the face in the case of a playing card. Also, a "back design" refers to the design shown on the back face of the playing card, which is common to all the cards. The type shown on the face is different for each playing card included in one deck. Also, the design on the back face is the same for all. In a normal game using playing cards, only one deck is used, but in a casino, a game may be played using a plurality of decks with the same design.

With the card 2 to be used by the card shuffling system of Embodiment 1 of the present invention, information for determination of proper/improper of the card is added by invisible ink or material on the face where there is the index enabling identification of the type, that is, the "suit" or the "rank", of the card. This ink or material includes a molecule that produces fluorescence reflection, and the proper/improper of a card may be determined by the reflected light, but under a normal use condition, the ink or material cannot be perceived by the eyes of a human. As an example application, the DNA-containing paint may be used as the ink for printing the index representing the "suit" or the "rank", and cards may be made highly complex by including DNAs whose types are different for each color of the indices.

With the card which is an example application of the present embodiments, the DNA-containing paint may be applied, as the group information, to the card as anchor paint for adjusting the base sheet of the card. Also, the DNA-containing paint may be applied to the card as the coating paint on the outer side of the card. A structure where the DNA-containing paint representing the group information is applied to a card as at least a part of the paint for printing the back face of the card, or a structure where the DNA-containing paint includes a plurality of types of DNAs and where the group information includes one or a plurality of DNAs among the plurality of types of DNAs is effective in making decoding by a cheater difficult.

An example modification of the present embodiments will be described below. In the present example modification, as a method of applying the DNA-containing paint to the card 2, transparent DNA-containing paint (ink or the like) is applied to a blank space 113 (shown in FIG. 4) below the index position, instead of including the DNA-containing paint in the ink for printing the index 2M to be applied. Moreover, two types of UV light with different wavelengths, for example, are radiated on the DNA-containing paint, on two spots (P1, P2), respectively, by DNA sensors 16. In this case, different signals are respectively returned from the transparent DNA-containing paint. The transparent DNA-containing paint here is structured to react differently to UV lights of different wavelengths and to return different reflected light. The two DNA sensors 16 obtain different reflected light from different irradiated light, and thereby acquire different pieces of group information. With one piece of group information, if by any chance the information is leaked to a cheater, the DNA-containing paint may be replicated and a dishonest act may be enabled, but by radiating two types of UV light and obtaining two different pieces of group information, security against a dishonest act may be increased. The example described above is advantageous also with respect to the cost because the DNA sensors 16 provided to the two card set trays 3 are to each radiate fluorescent (UV) light of a different wavelength.

The group information, according to the present embodiments, as the information for determination of proper/improper of a card is added to the card as DNA-containing paint, and it is needless to say that the group information may be group information common to a casino, or that group information different for each table may be used. Moreover, the group information may be group information whose type is different for each card supplier (card shoe or the like), or group information that is different for each production lot or for each casino may be set. Furthermore, it is also conceivable to apply the DNA-containing paint as the group information to a card as a dedicated index for group information other than the index representing the back design, the number or the suit of the card.

Next, the invisible ink or material used for adding information for determination of proper/improper of a card to the card 2 will be further described. This ink or material has been developed by nanotechnology and molecular science, and achieves a security function based on an invisible molecular sequence (DNA or the like) by forming a sign code or an encryption code by a combination of DNAs. The sign code or an encryption code based on a molecular sequence (DNA or the like) is a complex of chemical substances of about 0.5 to 5 microns, between the sizes of a single atom and a polymer, and there is an almost infinite number of types (about 30 trillion or more), and production or reproduction may be easily performed. Also, to prevent forgery or reading, a proper sign code may be inserted among a large number of improper codes. It is almost impossible for a forger to replicate the same codes, and also, to tell which is the proper sign code, and thus, the security is high. Moreover, since the sign code or the encryption code based on a molecular sequence (DNA or the like) is transparent and invisible, even if the DNA or the like is used being mixed in a transparent liquid or ink, normally, one cannot even know whether the DNA or the like is mixed. It is extremely difficult to remove or inactivate only the sign code or the like based on a molecular sequence (DNA or the like), or to disable the function.

When the sign code based on a molecular sequence (DNA or the like) is irradiated by specific light such as UV light of a narrow bandwidth, complex light combining specific wavelengths according to the sign code is returned. By converting this returned light into an electrical signal by an optical sensor (an optoelectronic sensor) and decoding the signal, presence or absence of an intended sign code may be determined. The molecular sequence (DNA or the like) forming the sign code or the encryption code may be used by mixing only a small amount thereof in a target substance such as pulp, ink or varnish. The substance itself is stable, and does not influence the target substance used for mixing, and use of ink of the molecular sequence (DNA or the like) or the like does not influence the normal production procedure or production speed.

Determination of the molecular sequence (DNA or the like) may be performed almost in real time (in reality, 0.01 seconds or less) by using an appliance that decodes the optoelectronic signal that is returned when specific light is radiated on a target object. Conventional methods are disadvantageous compared to the case of using the molecular sequence (DNA or the like) because, for example, a common hologram is visible, and a method of using specific metal particles as group information allows replication even when the particles are not visible.

Additionally, in the present embodiments, molecular sequence (DNA or the like)-containing paint and a molecular sequence (DNA or the like) sensor for detection thereof are used. The group information based on the molecular sequence (DNA or the like)-containing paint is an example of group information which cannot be read by the eyes of a human, and which may be read under a predetermined condition. As the molecular sequence (DNA or the like) used for coding the group information, natural molecular sequence (DNA or the like), artificial molecular sequence (DNA or the like), or the like may be used, for example. Moreover, any molecular sequence of a cyclic sequence, such as the base sequence of the molecular sequence (DNA or the like), may be used for coding of the group information. For example, the group information may be coded using an amino-acid sequence of protein.

Various embodiments of the present invention have been described above, but modifications may, of course, be made to the embodiments described above by those skilled in the art within the scope of the present invention. For example, the present invention may be used for games other than baccarat, such as blackjack, and the modes of the devices of the present embodiments may be changed as appropriate depending on the game for which the devices are to be used. Also, the present invention may be used for cards other than the playing cards, such as trading cards, and it is needless to say that the present invention is effective when there is a need to shuffle a predetermined set of cards before a game and may be widely used with respect to various games in which the proper/improper of the cards has to be determined.

While there has been described what is at present considered to be preferred embodiments of the invention, it is to be understood that various modifications may be made thereto, and it is intended that appended claims cover all such modifications as fall within the true spirit and scope of the invention.

The invention claimed is:

1. A portable shuffling device comprising:

two card set trays which are configured to receive stacks of a plurality of cards that are to be shuffled;

a common card stocker which is configured to collectively stock cards drawn out from the two card set trays;

first drawing means and second drawing means which are provided respectively below the two card set trays so as to draw out cards from the card set trays into the common card stocker one by one;

a motor which is configured to drive the first drawing means and the second drawing means; and control means which is configured to perform control of selectively operating the first drawing means and the second drawing means so as to selectively draw out the card that is on either of the two card set trays wherein the device stocks cards placed on the two card set trays collectively in the common card stocker and shuffles the plurality of cards wherein the control means includes number-of-cards determining means, the number-of-cards determining means being configured to determine the number of cards to be drawn out of the two card set trays by randomly changing the number of cards to be drawn out of the two card set trays at one time within a range of a predetermined value, and being configured to control the drawing means, where a card is drawn out only from one of the two card set trays such that cards are not simultaneously drawn out from the two card set trays, and wherein the number-of-cards determining means further includes a function for restricting a difference between the numbers of cards to be fed from the two card set trays to be within a predetermined number of cards.

2. The portable shuffling device according to claim 1, comprising:

pairs of feed rollers which are configured to send cards drawn out respectively from the first drawing means and the second drawing means to the card stocker, wherein the feed rollers are set to feed the cards at a higher speed than a speed of the cards drawn out from respective drawing means.

3. The portable shuffling device according to claim 2, comprising:

card sensors which are configured to detect the cards fed by the feed rollers; and a shuffled card counter which is configured to count, using the card sensors, the number of the cards stocked in the common card stocker.

4. The portable shuffling device according to claim 3, comprising:

output means which is configured to detect whether the number determined by the shuffled card counter and a number of cards set in advance match or not, and outputting the results of a match or nonmatch.

5. The portable shuffling device according to claim 4, further comprising:

a card removal lock device which is configured to prevent removal of cards from the card stocker in a case where the number according to the shuffled card counter and the number of cards set in advance do not match.

6. The portable shuffling device according to claim 5, further comprising:

a reset switch with a key; and the control means which is configured to perform control such that, in a case where the number according to the shuffled card counter and the number of cards set in advance do not match, release of the card removal lock device and start of a shuffling operation cannot be performed without using the reset switch with a key.

7. The portable shuffling device according to claim 1, wherein the motor for driving the first drawing means and the second drawing means is one common motor, and is structured to operate only one of the first drawing means and the second drawing means by switching a rotation direction between left and right.

8. The portable shuffling device according to claim 1, wherein the plurality of cards that are to be shuffled are divided and placed on the two card set trays, the number of the cards stocked in the common card stocker is added up and a total number of the shuffled cards is aggregated, a shuffling operation is temporarily stopped when a predetermined number of cards have been stocked in the common card stocker, the shuffling operation is performed again after the cards stocked in the common card stocker have been removed, and a plurality of cards included in a predetermined number of decks are shuffled by a plurality of shuffling operations.

9. The portable shuffling device according to claim 1, further comprising:

nonshuffled card detection means which is configured to detect and output absence of cards in at least one of the two card set trays.

10. The portable shuffling device according to claim 1, further comprising:

an abnormality determination device which is configured to examine a surface or a design of the card.

11. The portable shuffling device according to claim 10, further comprising:

a card removal lock device which is configured to prevent removal of cards from the card stocker in a case where an abnormality is detected by the abnormality determination device.

12. The portable shuffling device according to claim 11, further comprising:

a reset switch with a key; and the control means which is configured to perform control such that, in a case where an abnormality is detected by the abnormality determination device, release of the card removal lock device and start of a shuffling operation cannot be performed without using the reset switch with a key.

13. The portable shuffling device according to claim 1, further comprising:

a proper/improper determination device including a memory storing information about a proper card for determining whether one or more of the plurality of the cards that are to be shuffled are proper or improper, the proper/improper determination device sequentially acquiring, from the plurality of the cards that are to be shuffled, information added to the card relating to whether the card is proper or improper, comparing the acquired information with the information about a proper card, and determining whether the card is proper or improper.

14. The portable shuffling device according to claim 13, wherein the control means includes a function for stopping an operation, when a card is determined to be improper by the proper/improper determination device, in a state where the card determined to be an improper is placed at a top of the card stocker.

15. The portable shuffling device according to claim 14, further comprising:

a card removal lock device which is configured to prevent removal of cards from the card stocker in a case where a card is determined to be improper by the proper/improper determination device.

16. The portable shuffling device according to claim 15, further comprising:

a reset switch with a key; and the control means which is configured to perform control such that, in a case where a card is determined to be improper by the proper/improper determination device, release of the card removal lock device and restart of a shuffling operation cannot be performed without using the reset switch with a key.

17. The portable shuffling device according to claim 14, wherein the information is added to the card by invisible ink or material to a surface where there is a mark allowing identification of a type or the like of the card is taken as a shuffling target.

18. The portable shuffling device according to claim 16 wherein the ink or material includes a molecule that produces fluorescence reflection, and enables determination of proper/improper of a card by reflected light.

19. A card shuffling system comprising:

a plurality of cards each having proper/improper information added to a card surface by invisible ink or material for determining whether the card is proper or improper; and a device which is configured to have the cards divided and placed on two card set trays, and to stock the cards in a common card stocker and to shuffle cards;

wherein the device for shuffling the plurality of cards includes:

the two card set trays which are configured to receive stacks of the plurality of the cards to be shuffled, a common card stocker which is configured to collectively stock cards drawn out from the two card set trays;

first drawing means and second drawing means which are provided respectively below the two card set trays so as to draw out cards from the two card set trays into the common card stocker one by one;

a motor which is configured to drive the first drawing means and the second drawing means; and control means which is configured to perform control of selectively operating the first drawing means and the second drawing means so as to selectively draw out the card that is on either of the two card set trays, wherein the control means includes:

number-of-cards determining means which is configured to determine the number of cards to be drawn out of the two card set trays by randomly changing the number of cards to be drawn out of the two card set trays at one time within a range of a predetermined value, and is configured to control the drawing means, where a card is drawn out only from one of the two card set trays such that cards are not simultaneously drawn out from the two card set trays;

the number-of-cards determining means further including a function for restricting a difference between the numbers of cards to be fed from the two card set trays to be within a predetermined number of cards; and a proper/improper determination device including a memory which is configured to store information about a proper card in order to determine whether the cards that are to be shuffled are proper or improper, the proper/improper determination device being configured to sequentially acquire, from the plurality of cards that are to be shuffled, the proper/improper information added to the card, compare the proper/improver information added to the card with the information about a proper card, and determine whether the card is proper or improper.

20. The card shuffling system according to claim 19, wherein the control means includes a function for stopping an operation, when the card is determined to be improper by the proper/improper determination device, in a state where the card determined to be improper is placed at a top of the card stocker.

21. The card shuffling system according to claim 19, comprising:

pairs of feed rollers which are configured to send cards drawn out respectively from the first drawing means and the second drawing means to the card stocker, wherein the feed rollers are set to feed the cards at a higher speed than a speed of the cards drawn out from respective drawing means.

22. The card shuffling system according to claim 19, comprising:

card sensors which is configured to detect the cards fed by the feed rollers; and a shuffled card counter which is configured to count, by using the card sensors, the number of the cards stocked in the common card stocker.

23. The card shuffling system according to claim 19, wherein the motor is configured to drive the first drawing means and the second drawing means is one common motor, and is structured to operate only one of the first drawing means and the second drawing means by switching a rotation direction between left and right.

24. The card shuffling system according to claim 19, wherein the plurality of cards that are to be shuffled are divided and placed on the two card set trays, the number of the cards stocked in the common card stocker is added up and a total number of the shuffled cards is aggregated, a shuffling operation is temporarily stopped when a predetermined number of cards have been stocked in the common card stocker, the shuffling operation is performed again after the cards stocked in the common card stocker have been removed, and a plurality of cards included in a predetermined number of decks are shuffled by a plurality of shuffling operations.

25. The card shuffling system according to claim 19, further comprising:

nonshuffled card detection means which is configured to detect and output absence of cards in at least one of the two card set trays.

26. The card shuffling system according to claim 19, comprising:

output means which is configured to detect whether the number determined by the shuffled card counter and the number of cards set in advance match or not, and outputting the results of match or nonmatch.

27. The card shuffling system according to claim 26, further comprising:

a card removal lock device which is configured to prevent removal of cards from the card stocker in a case where the number according to the shuffled card counter and the number of cards set in advance do not match.

28. The card shuffling system according to claim 27, further comprising:

a reset switch with a key; and the control means which is configured to perform control such that, in a case where the number according to the shuffled card counter and the number of cards set in advance do not match, release of the card removal lock device and start of a shuffling operation cannot be performed without using the reset switch with a key.

29. The card shuffling system according to claim 19, further comprising:

an abnormality determination device which is configured to examine a surface or a design of the card.

30. The card shuffling system according to claim 29, further comprising:

a card removal lock device which is configured to prevent removal of cards from the card stocker in a case where an abnormality is detected by the abnormality determination device.

31. The card shuffling system according to claim 30, further comprising:

a reset switch with a key; and the control means which is configured to perform control such that, in a case where an abnormality is detected by the abnormality determination device, release of the card removal lock device and start of a shuffling operation cannot be performed without using the reset switch with a key.

32. The card shuffling system according to claim 19, further comprising:

a card removal lock device which is configured to prevent removal of cards from the card stocker in a case where a card is determined to be improper by the proper/improper determination device.

33. The card shuffling system according to claim 32, further comprising:

a reset switch with a key; and the control means which is configured to perform control such that, in a case where a card is determined to be improper by the proper/improper determination device, release of the card removal lock device and restart of a shuffling operation cannot be performed without using the reset switch with a key.

34. The card shuffling system according to claim 19, wherein the proper/improver information is added to the card surface by invisible ink or material is a mark allowing identification of a type or the like of the card is taken as a shuffling target.

35. The card shuffling system according to claim 19, wherein the ink or material includes a molecule that produces fluorescence reflection, and enables determination of proper/improper of a card by reflected light.

* * * * *